United States Patent [19]

Edgar

[11] 4,239,600

[45] Dec. 16, 1980

[54] TALL COKE OVEN SOLE FLUE

[75] Inventor: William D. Edgar, Allison Park, Pa.

[73] Assignee: Koppers Company, Inc., Pittsburgh, Pa.

[21] Appl. No.: 116,859

[22] Filed: Jan. 30, 1980

[51] Int. Cl.[3] ..... C10B 5/00; C10B 29/02

[52] U.S. Cl. ..... 202/138; 202/222

[58] Field of Search ..... 202/138, 139, 140, 141, 202/142, 143, 144, 222, 223, 224, 225, 267, 270

[56] References Cited

U.S. PATENT DOCUMENTS

| | | | |
|---|---|---|---|
| 1,025,419 | 5/1912 | Moss | 202/138 |
| 2,098,013 | 11/1937 | Pavitt | 202/142 |
| 3,042,590 | 7/1962 | Van Ackeren | 202/144 |
| 3,072,540 | 1/1963 | Otto | 202/141 |
| 3,806,426 | 4/1974 | Helm et al. | 202/144 X |

*Primary Examiner*—Frank W. Lutter
*Assistant Examiner*—Roger F. Phillips
*Attorney, Agent, or Firm*—R. Lawrence Sahr

[57] ABSTRACT

In a slot-type coke oven battery, the sole flues side walls are constructed of two or more courses of clay liners. The sole flues also include a bottom liner means and are topped with rider tile. The intersections of the successive courses of liners are maintained in position by refractory cross-ties. Ports in the rider tile feature internal venturi shapes which enhance the flow of gases therethrough.

10 Claims, 5 Drawing Figures

TALL COKE OVEN SOLE FLUE

BACKGROUND OF THE INVENTION

1. Field of the Invention

The present invention relates to coke oven batteries, particularly to slot-type oven coke oven batteries, and specifically to the design and arrangement of the sole flues in batteries which incorporate high slot-type ovens, extending in height to twenty feet or more.

2. Description of the Prior Art

The sole flues of a coke oven battery are open passages, located beneath each regenerator, through which combustion air is fed from the sides of the battery to the bottom of the regenerator chambers. The sole flues also collect the waste products of combustion from the bottom of the regenerators and conduct these gases to the sides of the battery where they are carried away in the waste heat flues.

The sole flue is a long, open, rectangular manifold, usually open on one end and closed on the other. The top of the sole flue is provided with a series of openings which control the flow of air from the sole flue into the bottom of the regenerator, and the flow of waste gases from the bottom of the regenerator into the sole flue. The air that flows through the sole flue into the regenerator is relatively cold while the waste gases that flow from the regenerator into the sole flue are in the range of the operating temperature of the coke oven battery. The air flows through a given sole flue on the "up" or burning cycle. After about a half hour, the flow is reversed, the air flow is cut off and waste gases are conducted from the regenerator into the sole flue. These two alternate flow patterns form a cycle. After the waste gas has flowed through the sole flue for about a half hour, the flow is reversed and the cycle is repeated. In the "up" cycle, blast furnace gas or "lean gas" may be added to the air to reduce the amount of coke oven gas required for the combustion that occurs above the regenerators between the oven chambers.

When the flow patterns are reversed, one to the other, there is a very rapid increase or decrease in the temperature in the sole flue producing a "thermal shock" to the refractory material from which the sole flue is constructed. This thermal shock tends to rapidly deteriorate the normal refractory materials. Thus, clay sole flue liners are used to protect the other refractory materials from this thermal shock.

Coke oven battery designs, recently, have increased in size, from the older standard height of about twelve feet to a height of twenty feet or more. To operate these tall batteries, larger burner chambers, burners and regenerators are required. This has necessitated larger volume sole flues. Since the width of the coke ovens has not varied, the underworks, including the regenerators and sole flues cannot be varied much in width. Therefore the height of both has been increased. An increase in sole flue volume is also necessitated by the use of lean gas, because sufficient air for combustion still must be introduced in addition to the lean gas that is flowed through the sole flue to the regenerators. And, as suggested before, such lean gas usage also dictates an increase in the sole flue height.

Sole flues are usually rectangular in cross section, and quite long in length vis-a-vis the cross-sectional dimensions. For example, a sole flue might be $13\frac{1}{8}''$ wide $\times 31\frac{1}{4}''$ high $\times 50'$ long, forming a chamber of those dimensions. The chamber is lined with clay liners in the form of flat rectangular plates. Because of structural limitations in the clay material, the plates cannot be stacked, end to end, to achieve height. Therefore, the height of the side liners needs to be generally equivalent to the height of the chamber plus some overlap to mate the sides with the bottoms. The bottom liners are between 2" and 3" thick, thus the side liners, in the dimensional example stated, need to be $33\frac{1}{4}''$ to $34\frac{1}{4}''$ in height to achieve a chamber height of $31\frac{1}{4}''$, the design height required for a twenty foot oven.

In the field of manufacturing refractories for industrial use, the largest commonly available equipment, a Boyd "Y" press, will produce a refractory with a maximum length of 36". However, refractory shapes of maximum length are not made without difficulty; it is difficult to fill the corners of the molds when they are extended to maximum limits. This often results in missing corners and/or poorly bonded material at the corners.

The 36" maximum length which can be produced by the Boyd "Y" press is the length of the slope in the green, or unfired state. In the case of the clay liners used for sole flues, the shrinkage, due to firing, reduces the molded shape from 36" to $34\frac{1}{4}''$. However, the dimensions of the shapes after firing are not uniform. There is a requirement that the liners have parallel sides and square corners to permit them to be fitted together without undue leakage. Thus, to achieve these characteristics, the refractory manufacturers must grind the edges of the shapes after firing. This grinding operation requires the removal of substantial refractory material to achieve the parallel sides and square corners. Because of the substantial warpage incurred when the green liner shapes are fired, many times the grinding required, to produce parallel sides and square corners, reduces the shape to less than the required dimension, thus making that shape unusable, i.e., it must be scrapped.

Another problem has developed from the inherent warpage which results from the firing of the clay liner shapes. Due to the flow characteristics that are required in the sole flue, the liners must have no more than a 3/16" tolerance on the flat face surfaces. The warpage that results from firing exceeds this limitation in a substantial number of cases because the overall large size of the shapes. These flat surfaces cannot be economically ground. Therefore, the shapes which are warped more than 3/16" must be scrapped.

Because of the problems of warpage, and of corner formation, the overall scrap rate in producing the clay liners has been in the 90 percentile range, rendering the cost of the acceptable shapes prohibitive.

In the design of sole flues, the top section, or the "rider tile", are supported by the side clay liners. Due to the relatively extreme height of the clay liners, required for the tall ones, the structural integrity of those tile is reduced. The cause of this reduction in structural integrity appears to be the compounding of internal stresses over a larger cross-sectional area as develops when the clay liners are subjected to the phenomena of thermal shock, as explained before. Thus, there is a proportional increase in the incidence of sole flue collapse that is directly related to the height of the clay liners.

In retrospect, the clay liners for the tall ovens are extremely expensive to manufacture due to the high scrap rates. Thus there is a need to establish a sole flue design which does not utilize the large clay liners, to enable economical manufacturing techniques to be utilized. In addition there is a need to establish a sole flue design which enhances the structural integrity of the clay liners in operation, thus providing a greater resistance to the devastating effects of thermal shock.

SUMMARY OF THE INVENTION

In a slot-type coke oven battery, the sole flues are generally positioned, in the battery structure, as is well known in the field of art. That is, the sole flues lie immediately beneath the regenerators, being separated virtually therefrom by the rider tile. The rider tile contain ports through which gases can pass. The rider tile are supported by clay liners which form the interior walls of the sole flue. There are two or more courses of clay liners, each successively above the other. Thus each liner vertically covers only a portion of the sole flue interior side. In the preferred embodiment, horizontally, along each wall of the sole flue, there are two courses of liners; thus, each liner in the second course is positioned, vertically, directly above a corresponding liner in the first course. Between each two corresponding liners courses is a horizontal joint. Between the set of two corresponding liners is a vertical joint. In the preferred embodiment, notches are cut at the corners of each of the liners which lie adjacent to both the horizontal joints. Thus, an aperture appears in the mosaic structure of the side walls at what would otherwise be the point of intersection of four corners of the four adjacent clay liners. An end of a refractory cross-tie is inserted into this aperture. In the preferred embodiment, the cross-section of the cross tie is larger than the aperture with both of the ends being stepped down to a size which will fit into that aperture. The opposite side wall of the sole flue is similarly arranged to that described, with the opposite end of the cross-tie inserted into the aperture which lies directly across the sole flue from the side wall previously described. This sequence of apertures and interlocked cross-ties is repeated, for each vertical pair of successive liners, along the horizontal length of the sole flue. The larger, or mid-section of each cross-tie is sufficiently long enough to buttress the opposed side walls and maintain them in position. Thus, they are prevented from collapsing inward into the sole flue interior. Alternately, a mosaic system without apertures may be utilized whenever the cross-ties are buttressed against the four-corner joint and held in place by supports of a suitable type.

DETAILED DESCRIPTION

Figure 1:
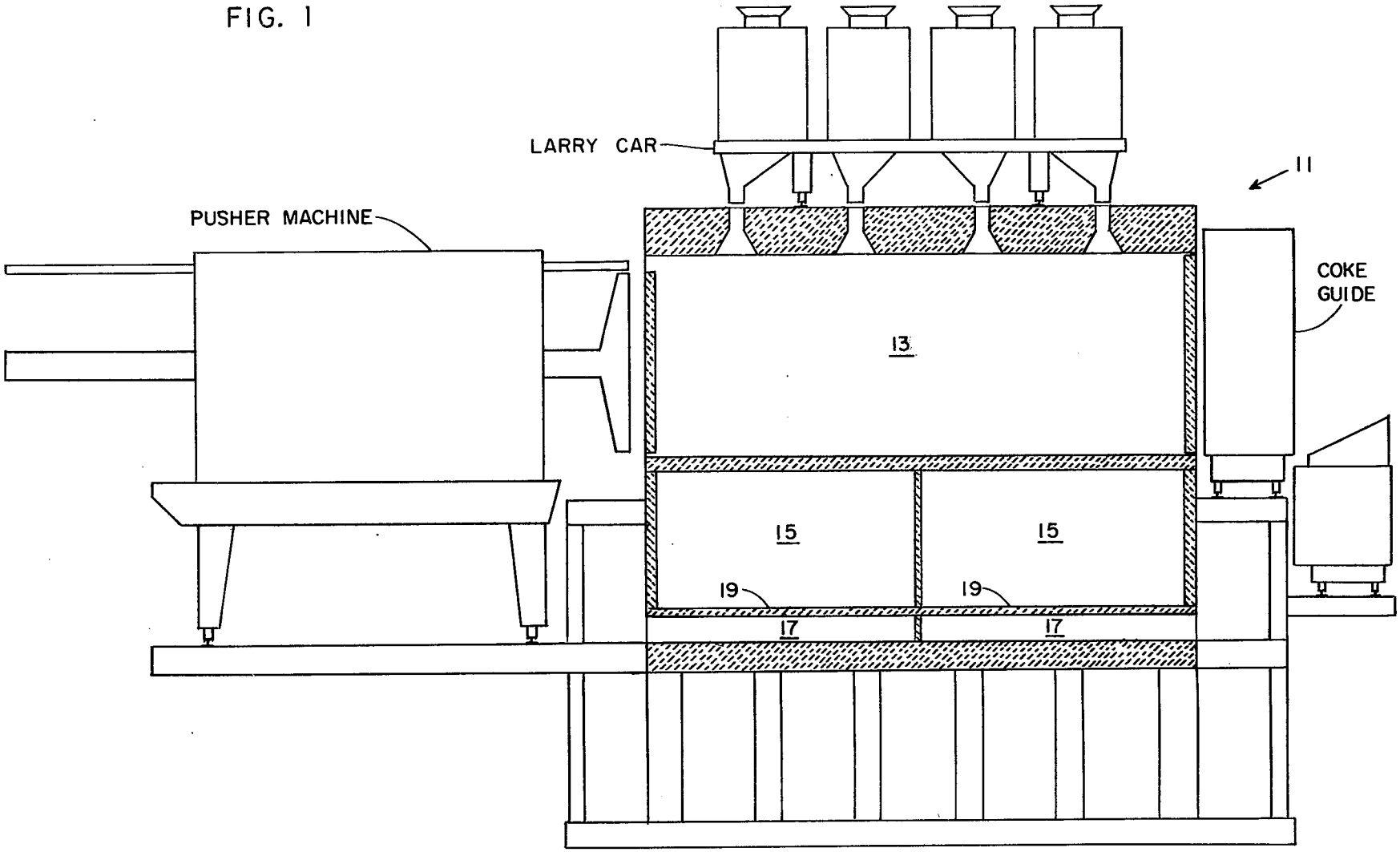
FIG. 1 is a schematic sectional elevational view from the end of a coke oven battery, showing the sole flue in relation to the other major sections of a conventional coke oven battery.
Figure 2:
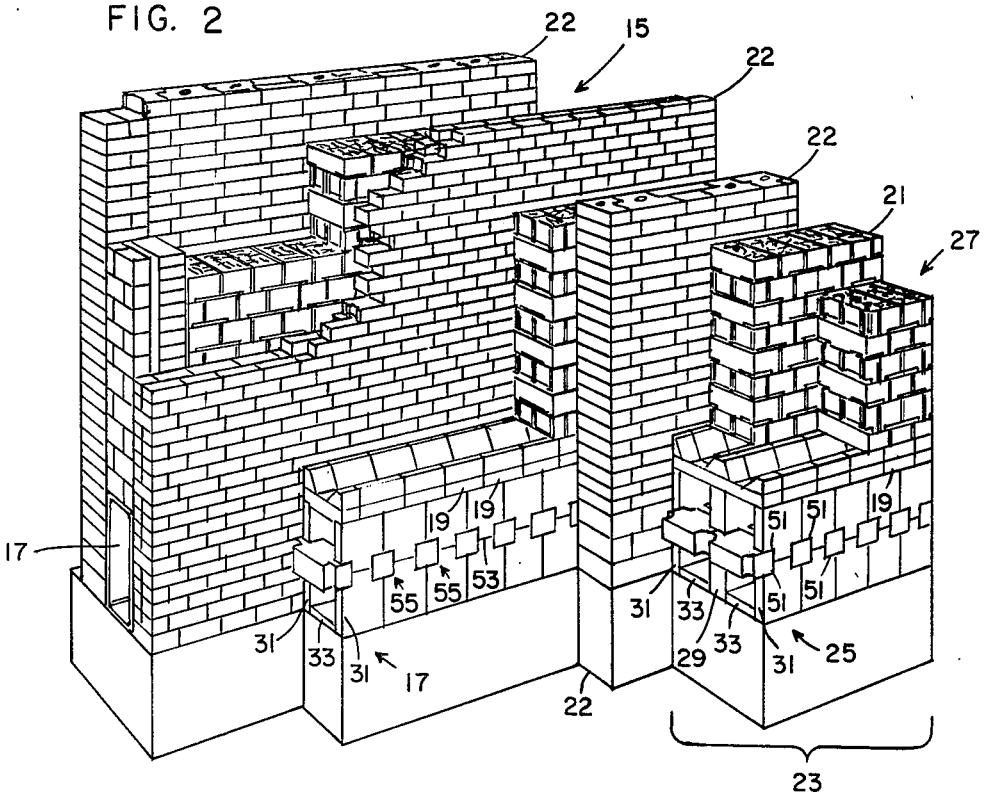
FIG. 2 is a projection view of the sole flue arrangement of the invention in relation to the regenerators.

Referring to FIG. 1, a cross-sectional view of a slot-type coke oven battery 11 is illustrated. Of particular interest in this view are the oven 13, the regenerator chambers 15, directly beneath the oven 13, and the sole flue 17 directly below the regenerator chambers 15. The sole flue 17 is separated from the regenerator chambers 15 by rider tile 19. The regenerator chamber 15 is filled with regenerator checker brick 21 as shown in FIG. 2, each chamber 15 being separated from the next adjacent chamber 15 by a separator wall 22. The regenerator checker brick 21 and separator walls 22 are composed of refractory material. The separator walls 22 extend downwardly to separate the sole flues 17 under the respective regenerator chambers 15 as shown in FIG. 2. As will be noted in FIG. 2, alternate designs 23 eliminate some of the separator walls 22 and feature a double regenerator chamber 25 with directly adjacent sole flues 17. Such an alternate design 23 arrangement is characteristically used in tall oven batteries but is not unheard of in batteries with the shorter height ovens. An enlarged section of a directly adjacent double sole flue 17 arrangement is shown in larger detail in FIG. 5. Both FIG. 2 and FIG. 5 illustrate the detail of the preferred embodiment of the sole flue 17 design.

Figure 3:
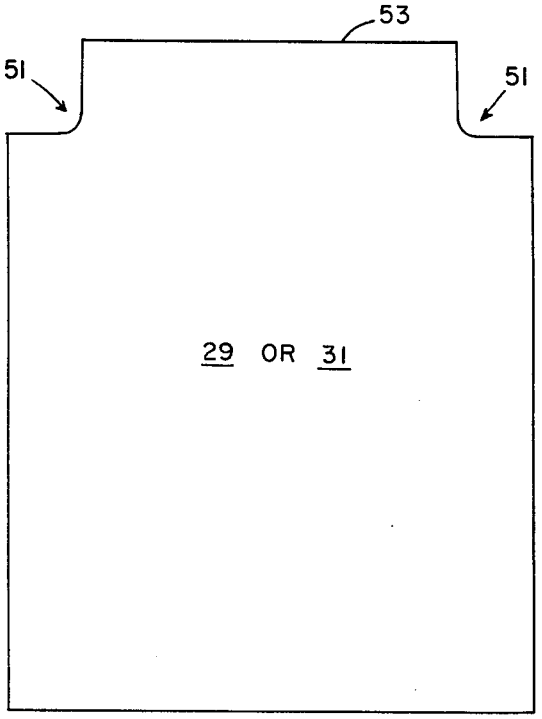
FIG. 3 is an elevational view of a clay liner according to the invention.
Figure 5:
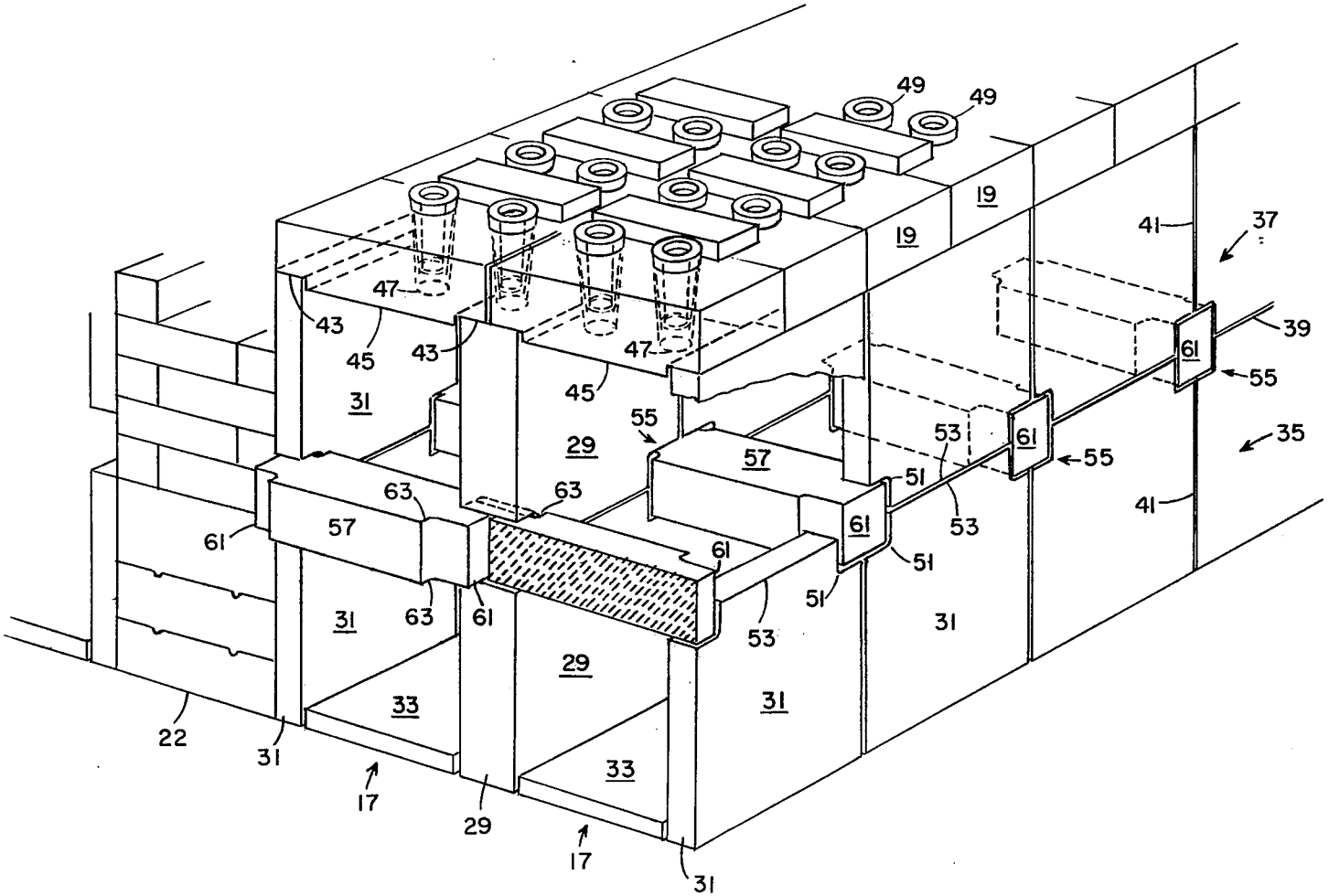
FIG. 5 is a projection view of the clay liners and cross-ties in position in a sole flue.

Referring to FIG. 5, a double sole flue 25 is illustrated which corresponds to the previously mentioned double regenerator chamber 27 as illustrated in FIG. 2. It will be noted that there is no separator wall 22 in the alternate design 23 between each of the two sole flues 17 of the double sole flue 25 or between the checker brick 21 arrangements of the individual regenerator chambers 15 of the double regenerator chamber 27. However, the double sole flue 25 is divided by a divider liner 29 which is generally about twice the thickness of the side liners 31. FIG. 3 illustrates an elevational view of either divider liner 29 on side liner 31.

At the bottom of the sole flue 17 or double sole flue 25, as the case may be, are floor liners 33 which are generally flat rectangular clay shapes generally corresponding in length to the length of the divider liners 29 and side liners 31.

Vertically, there are two courses 35, 37 of both the divider liners 29 and side liners, hereinafter referred to as the bottom course 35 and the top course 37, although one or more additional courses (not shown) might be added above the top course 37. A horizontal joint 39 separates the bottom course 35 and the top course 37. A vertical joint 41 separates each liner 29, 31, in a given course, 35 or 37, from each other.

The top of the sole flue 17, and in the case of the preferred embodiment, the double sole flue 25, is formed of rider tile 19. Each of the rider tile 19, preferably, has a pair of steps 43 formed into its bottom face about as shown in FIG. 5. The portion which forms the face extension 45 of the rider tile 19 between the steps 43 is generally as wide in dimension, as the width of the floor liner 33. This face extension 45 drops below the uppermost edges of the top course 37 of the chamber liner 29 and side liners 31, thus serving to maintain the separated position of the uppermost edges of the top course 37 of the chamber liners 29 and side liners 31. The floor liners 33 serve the same function for the lowermost edges of the bottom course 35 of the divider liners 29 and side liners 31. Each of the rider tile 19 has one or more ports 47 extending transversally therethrough, from face to face. In the preferred embodiment, these ports 47 are in the form of a frusto-conical section with the larger diameter of that section being on the top face of the rider tile. A port insert 49, of an abrasion resistant refractory material, is inserted in each of the ports 47. The exterior of the port inserts 49 is also frusto-conical in shape and sized to mate with the corresponding ports 47. The interior of the port inserts 49 is in the form of a venturi to enhance the flow of gases from the sole flue 17 or double sole flue 25 into the regenerator chamber 15 or double regenerator chamber 27, as the case may be.

It should be noted that, due to the long length of the sole flue 17, or double sole flue 25, there is a pressure drop as gases flow therethrough. Thus, the size of the venturi form of the interior of the port inserts may be varied along the length of the sole flue 17, or double sole flue 25, to compensate for this pressure drop, the object being to equalize the volume of gas per unit of time, passing through all of the ports 47, thus producing a uniformity of gas flow through all portions of the regenerator chambers 15 or double regenerator chambers 27, respectively.

Referring to FIG. 3, it will be noted that there is a pair of notches 51 formed into the otherwise rectangular face of each of the divider liners 29 and side liners 31. These notches 51 are positioned at two consecutive corners of the liners 29, 31 and are in the form of a 90° angle with a radiused corner. The ends of the liners 29, 31 between the notches 51 is referred to as the notch end 53. Referring to FIG. 5, as well as FIG. 2, it will be noted that the bottom course 35 of the liners 29, 31 is arranged so that the notch ends 53 are all at the top, thus abutting the horizontal joint 39 and forming one edge thereto. On the other hand, the top course 37 of the liners 29, 31 is arranged so that the notch ends 53 are all at the bottom, forming the other edge of the horizontal joint 39. Thus the horizontal joint 39 is formed by the abutting and adjacent notch ends 53 of the liners 29, 31, respectively. The liners 29, 31 in the top course 37 are positioned, each directly above a liner 29, 31, respectively, in the bottom course 35, and the adjacent notches 51 form a notch aperture 55 at the point where four adjacent notches 51 meet, as illustrated in FIGS. 1 and 5.

Figure 4:
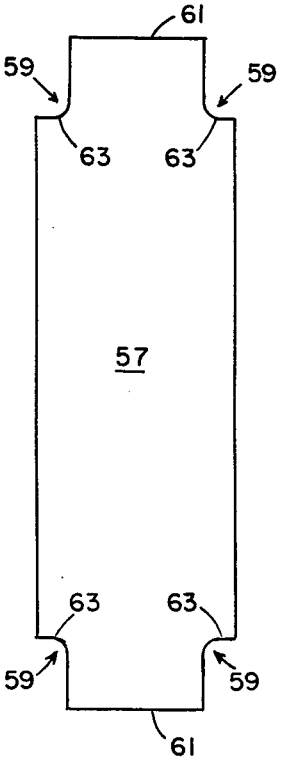
FIG. 4 is a plan view of a cross-tie according to the invention.

Referring to FIG. 4, there is illustrated a plan view of a refractory cross-tie 57. The cross-tie 57 is generally rectangular in the plan view with recesses 59 forming what would otherwise be the four corners of the rectangular shape. The recesses 59 are generally right-angular in shape with a radiused corner at the angular apex. In the view shown in FIG. 4, the horizontal dimension of the reduced ends 61 is less than the horizontal dimension of the cross-tie 57 at about mid-point of the cross-tie 57. The vertical depth of the recesses 59 is generally equivalent to the thickness of a side liner 29. The vertical dimension of the cross-tie 57, between the recesses 59, is generally equivalent to the width of the floor liners 33 and the face extension 45. The horizontal dimension of the reduced end 61 is equivalent to the thickness of the cross-tie 57, thus an end section appears generally as a square. The dimensions of this square section of the reduced end 61 are equivalent to the dimensions of the notch aperture 55 into which that reduced end 61 is fitted.

As mentioned before, in reference to FIG. 4, the horizontal dimension of the cross-tie 57 is greater than the horizontal dimension of the reduced ends 61. The difference between the two dimensions is the combined dimensions of the horizontal depths of the recesses 59. The square section of the reduced ends 61 are inserted into the notch apertures 55 as illustrated in FIG. 5; however, the depth of the insertion is only equivalent to what appears in FIG. 4 as the vertical depth of the recesses 59. At this point of the insertion, the steps 61 which are formed by recess 59 buttress against the respective liners 29, 31 adjacent the notch apertures 55, thus holding the four adjacent liners 29, 31 respectively, in position. In other words, the liners 29, 31 are prevented from collapsing into the sole flues 17, or double sole flues 25, by the cross-ties 57.

The divider liners 29, as mentioned before, are about twice the thickness of the side liners 31. And the vertical depth, as illustrated in FIG. 4, of the recesses 59 is equivalent to the thickness of a side liner 29. Thus the depth of the notch aperture 55 of four adjacent divider liners will accommodate two reduced ends 61 of two cross-ties 57, respectively. As indicated in FIG. 5, the reduced ends 61 of two cross-ties 57, respectively, are inserted from opposite sides of the divider liners 29. Thus the divider liners 29 are held in position on both sides by the cross-ties 57, whereas the side liners 31 are only held in position on only one side by the cross-ties 57. The faces of the side liners 31 which are opposite the interior of the sole flue 17, or double sole flue 25, are buttressed against refractory separator walls 22.

In the construction of either the sole flues 17 or double sole flues 25, some or all of the joints between the various shapes may be filled with a refractory cement for sealing purposes. However, under certain conditions, where substantial expansion or contraction, vis-a-vis the refractory shapes to each other, the use of refractory cement would not be advisable.

According to the patent statutes, the principles, the preferred embodiment and the best mode of operation of the present invention have been explained, illustrated and described. However, it is to be understood that, within the scope of the appended claims, the present invention may be practiced otherwise than as specifically illustrated and described.

What is claimed is:

1. In combination with a slot-type coke oven, a sole flue comprising:

(a) at least one floor liner of refractory material, positioned to form the bottom of a sole flue;

(b) a pair of side liner walls, each of which is composed of at least two vertical courses of refractory side liners, each said course of refractory side liners being composed of at least one refractory side liner, the lowermost portion of the lowermost course of said pair of side liner walls being maintained apart by said bottom of said sole flue;

(c) at least one rider tile, positioned to form the top of said sole flue, said at least one rider tile which includes means for maintaining uppermost portions of the uppermost course of said pair of side liner walls apart, to the same extent that said lowermost portions of said lowermost courses of said pair of side liner walls is maintained apart by said bottom of said sole flue, said at least one rider tile including a plurality of ports for conducting gases therethrough; and (d) refractory means for maintaining apart each of said pair of side liner walls from the other, and those portions of each successive course of said pair of side liner walls which are adjacent the horizontal joints which are created between each said successive courses of said pair of said side liner walls and which are also adjacent the vertical joints which are created between each two successive side liners in each said course of side liners, said means for maintaining apart operating to maintain apart those portions of said pair of side liner walls which are adjacent to both said horizontal joints and said vertical joints to the same extent that said lowermost course of said pair of side liner walls is maintained apart by said at least one floor liner.

2. The invention described in claim 1 wherein those said portions of said pair of side liner walls which are adjacent to both said horizontal joints and said vertical joints are formed to produce notch apertures in said pair of side liner walls, and wherein said refractory means for maintaining apart extends into said notch apertures.

3. The invention described in claim 2 wherein said refractory means for maintaining apart comprises at least one cross-tie positioned to extend transversally between said pair of side liner walls, each said cross-tie which includes a pair of reduced ends sized to fit into a pair of said notch apertures which are directly opposed and both horizontally and vertically aligned on said pair of side liner walls.

4. The invention described in claim 3 further comprising a plurality of port inserts, mounted within each of said ports, said port inserts which are composed of a refractory material and include axial venturi-shaped apertures therethrough.

5. The invention described in claim 4 wherein said ports and the exterior of said port inserts include matched frusto-conical shapes.

6. In combination with a slot-type coke oven, a double sole flue comprising:

(a) a plurality of floor liners of refractory material, arranged and positioned to form two parallel bottoms of a double sole flue;

(b) a divider liner wall, composed of at least two vertical courses of refractory divider liners, each said course of refractory divider liners being composed of at least one divider liner, said divider liner wall being positioned to separate said two parallel bottoms of said double sole flue;

(c) a pair of side liner walls, each of which is composed of at least two vertical courses of refractory side liners, each said course of refractory side liners being composed of at least one refractory side liner, said divider liner wall being positioned between said pair of side liner walls the lowermost portion of the lowermost course of said divider wall being maintained apart from the lowermost portion of the lowermost courses of said pair of side liner walls by said two parallel bottoms of said double sole flue, one each of said bottoms which is positioned on one side of said divider liner wall, the other said bottom which is positioned on the other side of said divider liner wall;

(d) a plurality of rider tile, positioned to form the top of said double sole flue, said plurality of rider tile which include means for maintaining the uppermost portion of the lowermost course of said divider liner wall apart from said the uppermost portions of the uppermost courses of said pair of side liner walls, to the same extent that said lowermost portion of said lowermost course of said divider liner wall is maintained apart from said lowermost portions of said lowermost courses of said pair of side liner walls by said two parallel bottoms of said double sole flue, said plurality of rider tile including a plurality of ports for conducting gases therethrough; and (e) refractory means for maintaining apart each of said pair of side liner walls from said divider wall, those portions of each said successive course of said pair of side liner walls, and those portions of each said successive courses of said divider liner wall, which are adjacent the horizontal joints which are created between each said successive courses of said pair of side side liner walls, and each said successive courses of said divider liner walls, respectively, said respective portions which are also adjacent the vertical joints which are created between each two successive side liners in each said course of side liners, and each two successive divider liners in each said course of divider liners, respectively, said means for maintaining apart operating to maintain apart those portions of said pair of side liner walls which are adjacent to both said horizontal joints and said vertical joints, from those portions of said divider liner wall which are adjacent to both said horizontal joints and said vertical joints, to the same extent that said lowermost portions of said lowermost course of said divider liner wall is maintained apart from said lowermost portions of said lowermost courses of said pair of side liner walls by said two parallel bottoms of said double sole flue.

7. The invention described in claim 6 wherein those said portions of said pair of side liner walls, and those said portions of said divider liner wall, which are adjacent to said horizontal joints and said vertical joints, respectively, are formed to produce notch apertures in said pair of side liner wall and said divider liner wall, respectively, and wherein said refractory means for maintaining apart extends into said notch apertures.

8. The invention described in claim 7 wherein said refractory means for maintaining apart comprises a plurality of cross-ties, each positioned to extend transversally between one of said pair of side liner walls and said divider liner wall, each said cross-tie which includes a pair of reduced ends sized to fit into a pair of said notch apertures which are directly opposed and both horizontally and vertically aligned on one of said pair of side liner walls and sais divider liner wall.

9. The invention described in claim 8 further comprising a plurality of port inserts, mounted within each of said ports, said port inserts which are composed of a refractory material and include axial venturi-shaped apertures therethrough.

10. The invention described in claim 9 wherein said ports and the exterior of said port inserts include matched frusto-conical shapes.

* * * * *